US007763579B2

(12) United States Patent
Briggs et al.

(10) Patent No.: US 7,763,579 B2
(45) Date of Patent: Jul. 27, 2010

(54) METHOD OF PREPARING A LAUNDRY PRODUCT

(75) Inventors: Stephen Leonard Briggs, Wirral (GB); Craig Warren Jones, Wirral (GB)

(73) Assignee: The Sun Products Corporation, Wilton, CT (US)

( * ) Notice: Subject to any disclaimer, the term of this patent is extended or adjusted under 35 U.S.C. 154(b) by 87 days.

(21) Appl. No.: 11/665,859

(22) PCT Filed: Sep. 23, 2005

(86) PCT No.: PCT/EP2005/010402

§ 371 (c)(1), (2), (4) Date: Oct. 17, 2007

(87) PCT Pub. No.: WO2006/045391

PCT Pub. Date: May 4, 2006

(65) Prior Publication Data

US 2008/0242580 A1 Oct. 2, 2008

(30) Foreign Application Priority Data

Oct. 29, 2004 (GB) ..... 0423986.9

(51) Int. Cl.
*C11D 3/00* (2006.01)

(52) U.S. Cl. ..... 510/515; 510/296; 510/295; 510/303; 510/405; 510/406; 510/437; 510/458; 510/522; 510/523; 510/527

(58) Field of Classification Search ..... 510/293, 510/296, 515, 297, 303, 321, 325, 328, 337, 510/339, 343, 405, 407, 420, 437, 439, 458, 510/522, 523, 527

See application file for complete search history.

(56) References Cited

U.S. PATENT DOCUMENTS

| | | | | | |
|---|---|---|---|---|---|
| 2,435,829 | A | * | 2/1948 | Guest | 554/213 |
| 2,566,359 | A | * | 9/1951 | Owen | 554/156 |
| 2,948,697 | A | * | 8/1960 | Robertson | 524/140 |
| 3,822,145 | A | * | 7/1974 | Liebowitz et al. | 427/378 |
| 3,844,952 | A | * | 10/1974 | Booth | 510/333 |
| 4,386,213 | A | | 5/1983 | Giesecke et al. | |
| 4,569,773 | A | | 2/1986 | Ramachandran et al. | 252/8.7 |
| 4,605,506 | A | | 8/1986 | Wixon | 252/8.75 |
| 4,775,492 | A | * | 10/1988 | Vipond et al. | 252/187.26 |
| 4,818,421 | A | | 4/1989 | Boris et al. | 252/8.8 |
| 4,851,138 | A | | 7/1989 | Jaroschek et al. | 252/88 |
| 5,225,100 | A | | 7/1993 | Fry et al. | 252/174.25 |
| 5,422,021 | A | * | 6/1995 | Turner | 510/515 |
| 5,507,970 | A | | 4/1996 | Ishikawa et al. | |
| 5,972,870 | A | | 10/1999 | Anderson | 510/298 |
| 6,103,687 | A | * | 8/2000 | Cody et al. | 510/504 |
| 6,278,008 | B1 | * | 8/2001 | Endo et al. | 554/227 |
| 6,391,845 | B1 | | 5/2002 | Speed et al. | |
| 6,486,117 | B1 | | 11/2002 | Painter et al. | |
| 6,495,503 | B1 | * | 12/2002 | Zappone et al. | 510/296 |
| 6,566,115 | B1 | | 5/2003 | Weisgerber et al. | 435/221 |
| 6,610,640 | B1 | | 8/2003 | Zappone et al. | |
| 6,727,220 | B1 | | 4/2004 | Grainger et al. | 510/475 |
| 6,815,410 | B2 | * | 11/2004 | Boutique et al. | 510/295 |
| 7,083,047 | B2 | | 8/2006 | Bone et al. | |
| 7,115,173 | B2 | | 10/2006 | Caswell et al. | |
| 7,304,025 | B2 | * | 12/2007 | Hardy et al. | 510/439 |
| 7,691,801 | B2 | * | 4/2010 | Briggs et al. | 510/471 |
| 7,718,596 | B2 | * | 5/2010 | Briggs et al. | 510/439 |
| 2001/0018410 | A1 | | 8/2001 | Grainger et al. | 510/515 |
| 2001/0034315 | A1 | * | 10/2001 | Grainger et al. | 510/327 |
| 2001/0053754 | A1 | * | 12/2001 | Hewitt et al. | 510/293 |
| 2002/0013243 | A1 | * | 1/2002 | Hewitt et al. | 510/293 |
| 2002/0055449 | A1 | * | 5/2002 | Porta et al. | 510/295 |
| 2002/0198125 | A1 | | 12/2002 | Jones | 510/296 |
| 2003/0054966 | A1 | | 3/2003 | Bone et al. | 510/296 |
| 2003/0134766 | A1 | * | 7/2003 | Jones et al. | 510/293 |
| 2003/0199414 | A1 | * | 10/2003 | Boutique et al. | 510/293 |
| 2003/0199415 | A1 | | 10/2003 | Mondin | 510/293 |
| 2004/0063928 | A1 | | 4/2004 | Jo | |
| 2004/0115375 | A1 | | 6/2004 | Duffield et al. | 428/34.1 |
| 2005/0205574 | A1 | * | 9/2005 | Lambotte et al. | 220/234 |
| 2006/0019866 | A1 | * | 1/2006 | Briggs et al. | 510/515 |
| 2006/0143834 | A1 | * | 7/2006 | Bhatia et al. | 8/115.51 |

(Continued)

FOREIGN PATENT DOCUMENTS

AU 14416/88 B 10/1988

(Continued)

OTHER PUBLICATIONS

Allen et al. "Carbohydrate-Alkyl Ester Derivatives as Biosurfactants". Journal of Surfactants and Detergents, vol. 2, No. 3 (Jul. 1999) p. 383-390.*

(Continued)

*Primary Examiner*—Mark Eashoo
*Assistant Examiner*—Jane L Stanley
(74) *Attorney, Agent, or Firm*—Sterne, Kessler, Goldstein & Fox P.L.L.C.

(57) ABSTRACT

A method of preparing a composition for use in a unit dose fabric treatment system, the method comprising the steps of reacting together, in the presence of water, a ester-containing soap precursor, a base material, and optionally a solvent.

22 Claims, No Drawings

U.S. PATENT DOCUMENTS

| | | | |
|---|---|---|---|
| 2006/0205631 | A1 | 9/2006 | Smerznak et al. |
| 2007/0287658 | A1 | 12/2007 | Briggs et al. |
| 2008/0242579 | A1 | 10/2008 | Briggs et al. |
| 2008/0261850 | A1 | 10/2008 | Briggs et al. |

FOREIGN PATENT DOCUMENTS

| | | | |
|---|---|---|---|
| CA | 2 450 149 | A1 | 12/2002 |
| CA | 2 562 113 | A1 | 10/2005 |
| CA | 2 583 298 | A1 | 5/2006 |
| EP | 0 845 523 | A2 | 6/1998 |
| EP | 1 431 381 | | 6/2004 |
| EP | 1 431 383 | B1 | 3/2006 |
| EP | 1 486 559 | | 5/2006 |
| FR | 2 780 411 | | 12/1999 |
| GB | 1 235 292 | | 6/1971 |
| GB | 1 598 102 | | 9/1981 |
| GB | 2 204 608 | A | 11/1988 |
| GB | 2 247 463 | | 3/1992 |
| JP | 2001-040398 | | 2/2001 |
| WO | WO 95/22594 | A1 | 8/1995 |
| WO | 98/16538 | | 4/1998 |
| WO | 02/102955 | | 12/2002 |
| WO | 02/102956 | | 12/2002 |
| WO | WO 02/097026 | A1 | 12/2002 |
| WO | 2004/011589 | | 2/2004 |
| WO | 2006/037469 | | 4/2006 |
| WO | WO 2006/045391 | A1 | 5/2006 |
| WO | 2006/076952 | | 7/2006 |

OTHER PUBLICATIONS

H. Maag, "Fatty Acid Derivatives: Important Surfactants for Household, Cosmetic and Industrial Purposes", JAOCS, vol. 61, No. 2 (Feb. 1984).*

GB Search Report in a GB application GB 0423986.9.

PCT International Search Report in a PCT application PCT/EP 2005/010402.

GB Search Report in a GB application GB 0422026.5.

PCT International Search Report in a PCT application PCT/EP 2005/010187.

GB Search Report in a GB application GB 0610801.3.

Co-pending application: Applicant: Briggs et al., U.S. Appl. No. 11/664,562, filed Apr. 3, 2007.

Derwent Abstract of FR 2 780 411, published Dec. 31, 1999.

Derwent Abstract of JP 2001 040398.

Thomssen et al., "*Soaps and Detergents*", MacNair-Dorland Company, (1949), pp. 259-269.

PCT International Search Report in a PCT application PCT/EP2007/055131.

English language Abstract for JP 2001-040398 A, published Feb. 13, 2001, Japanese Patent Office, Patent & Utility Model Gazette DB.

Final Rejection mailed Oct. 2, 2009, in U.S. Appl. No. 11/632,879, Briggs et al., filed Jan. 19, 2007 (9 pages).

International Search Report for International Application No. PCT/EP2005/006517, European Patent Office, Rijswijk, Netherlands, mailed on Oct. 31, 2005 (3 pages).

Non-Final Rejection mailed Aug. 25, 2009, in U.S. Appl. No. 11/807,556, Briggs et al., filed May 29, 2007 (5 pages).

Non-Final Rejection mailed Mar. 30, 2009, in U.S. Appl. No. 11/632,879, Briggs et al., filed Jan. 19, 2007 (8 pages).

Non-Final Rejection mailed Dec. 2, 2009, in U.S. Appl. No. 11/632,879, Briggs et al., filed Jan. 19, 2007 (8 pages).

Non-Final Rejection mailed Sep. 18, 2008, in U.S. Appl. No. 11/664,562, Briggs et al., filed Feb. 25, 2008 (5 pages).

Final Rejection mailed Jan. 7, 2010, in U.S. Appl. No. 11/664,562, Briggs et al., filed Feb. 25, 2008 (6 pages).

Notice of Allowance mailed Dec. 15, 2009, in U.S. Appl. No. 11/807,556, Briggs et al., filed May 5, 2007 (4 pages).

Search Report completed Nov. 18, 2004, for Great Britain Application No. GB0416155.0 (1 page).

* cited by examiner

METHOD OF PREPARING A LAUNDRY PRODUCT

FIELD OF THE INVENTION

This invention relates to a method of preparing laundry products, and in particular relates to a method of preparing unit dose fabric treatment systems.

BACKGROUND OF THE INVENTION

Detergent compositions manufactured in the form of compacted detergent powder are known. U.S. Pat. No. 5,225,100, for example, describes a tablet of compacted powder comprising an anionic detergent compound, which will adequately disperse in the wash water.

Laundry detergent compositions which further include a fabric softener to provide softening or conditioning of fabrics in the wash cycle of the laundering operation are well-known and described in the patent literature. See, for example, U.S. Pat. No. 4,605,506 (Wixon); U.S. Pat. No. 4,818,421 (Boris) et al. and U.S. Pat. No. 4,569,773 (Ramachandran et al.) and U.S. Pat. No. 4,851,138. U.S. Pat. No. 5,972,870 (Anderson) describes a multi-layered laundry tablet for washing which may include a detergent in the outer layer and a fabric softener, or water softener or fragrance in the inner layer.

These types of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. That is, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. However, these type products are characterised by the same inconvenience inherent with the use of powered detergents, namely, problems of handling, caking in the container or wash cycle dispenser, and the need for a dosing device to deliver the desired amount of active softener material to the wash water.

The use of a unit dose fabric softening composition contained in a water soluble container such as a sachet offers numerous advantages. To be effective, the unit dose fabric softening compositions, contained in a sachet, must be able to disperse in the wash liquor in a short period of time to avoid any residue at the end of the wash cycle.

Typically, the wash cycle time can be as short as 12 minutes and as long as 90 minutes (in typical European washers) depending on the type of washer and the wash conditions. Therefore, the water-soluble sachet must be soluble in the wash liquor before the end of the cycle.

Liquid unit dose softeners have been disclosed in our co-pending applications WO-A-02/102955, WO-A-02/102956 and GB 0222964.9.

OBJECT OF THE INVENTION

The aim of this invention is to seek to overcome one or more of the aforementioned disadvantages and/or to provide one or more of the aforementioned benefits.

STATEMENT OF THE INVENTION

Thus, according to the present invention there is provided a method of preparing a composition for use in a fabric treatment system in the form of a unit dose comprising:

(a) a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers; and (b) a liquid fabric treatment composition disposed in said water soluble container, wherein said fabric treatment composition comprises:

(i) one or more soaps, and (ii) optionally a plasticiser the method comprising the steps of reacting together, in the presence of water, (i) an ester-containing soap precursor, (ii) a base material, and (iii) optionally a solvent The composition is present in an amount within the water-soluble container which is sufficient to form a unit dose capable of providing effective softening, conditioning or other laundry treatment of fabrics in said washing machine.

DETAILED DESCRIPTION OF THE INVENTION

The present invention relates to a method of preparing a composition for use in a water soluble sachet.

Preferably the water soluble sachet is formed from a single layer of water soluble thermoplastic film.

The film is advantageously formed from a water soluble polymer which is preferably selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkylhydroxy cellulosic such as hydroxy ethylcellulose, hydroxypropyl cellulose, carboxy-methylcellulose sodium, dextrin, maltodextrin, alkyl cellulosics such as methyl cellulose, ethyl cellulose and propyl cellulose, ethers and esters of alkyl cellulosics such as methyl cellulose, ethyl cellulose and propyl cellulose, water soluble polyacrylates, water soluble polyacrylamides and acrylic acid/maleic anhydride copolymers.

Especially preferred water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Monosol LLC. Other suitable resins include poly(ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is PVA produced by Monosol LLC. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The inner surface of the film is in contact with the laundry treatment composition and the external surface of the film does not have a water soluble glue disposed thereon.

The water soluble container can be in the form of a pouch, sachet, a blow moulded capsule or other blow moulded shapes, an injected moulded ampoule or other injection moulded shapes, or rotationally moulded spheres or capsules.

Examples of suitable methods for forming water soluble containers are as follows:

The pelletized, pre-dried, melt processable polyvinyl alcohol (PVA) resin, is fed to a film extruder. The feed material may also contain pre-dried colour concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties.

Alternatively, the PVA resins can also be dissolved and formed into film through a solution-casting process, wherein the PVA resin or resins are dissolved and mixed in an aqueous solution along with additives. This solution is cast through a coat hanger die, or in front of a doctor blade or through a casting box to produce a layer of solution of consistent thickness. This layer of solution is cast or coated onto a drum or casting band or appropriate substrate to convey it through an oven or series of ovens to reduce the moisture content to an appropriate level. The extruded or cast film is slit to the appropriate width and wound on cores. Each core holds one reel of film.

There are many types of form fill seal machines that can convert water soluble films into containers, including vertical, horizontal and rotary machines. To make the appropriate sachet shape, one or multiple films can be used. The film can be folded into the sachet shape, mechanically deformed into the sachet shape, or thermally deformed into the sachet shape. The sachet forming can also utilize thermal bonding of multiple layers of film, or solvent bonding of multiple layers of film. When using poly(vinyl) alcohol the most common solvent is water.

Once the appropriately shaped sachet is filled with product, the sachet can be sealed using either thermal bonding of the film, or solvent bonding of the film.

Blow moulded capsules can be formed from the poly(vinyl) alcohol resin having a molecular weight of about 50,000 to about 70,000 and a glass transition temperature of about 28 to 33° C. Pelletized resin and concentrate(s) are fed into an extruder having a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split moulds. The moulds control the final shape of the package. While in the mould, the package is filled with the appropriate volume of liquid. The mould quenches the plastic. The liquid is contained within the interior volume of the blow moulded package.

An injection moulded ampoule or capsule can be formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection moulding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mould or hot runner system which feeds several moulds. The moulds control the shape of the finished package. The package may be filled with liquid either while in the mould or after ejection from the mould. The filling port of the package is heat sealed after filling is completed. This process may be conducted either in-line or off-line.

A rotationally moulded sphere or capsule can be formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mould having the desired shape and volume. The mould is sealed and heated while simultaneously rotating in three directions. The powder melts and coats the entire inside surface of the mould. While continuously rotating, the mould is cooled so that the resin solidifies into a shape which replicates the size and texture of the mould.

After formation of the finished package, the liquid is injected into the hollow package using a heated needle or probe after filling, the injection port of the package is heat sealed. Typical unit dose compositions for use herein may vary from about 5 to about 40 ml corresponding on a weight basis to about 5 to about 40 grams (which includes the weight of the capsule).

Fabric Treatment Composition

The composition comprises a soap which is formed in situ.

The method of preparing the composition comprises the steps of reacting together, in the presence of water, an ester-containing soap precursor, a base material, and optionally a solvent to produce one or more soaps and a plasticiser.

Ester-Containing Soap Precursor

The precursor is an agent which, under the desired conditions, liberates soap and a lower alcohol plasticiser.

Particularly preferred ester-containing soap precursors include fatty acid esters, particularly fatty acid triglycerides and alkylated sugar esters, particularly sucrose polyesters.

Fatty Acid Ester

Suitable fatty acid esters are fatty esters of mono or polyhydric alcohols having from 8 to about 24 carbon atoms in the fatty acid chain. Such fatty esters are preferably substantially odourless.

In at least one of the fatty acid esters, it is desirable the average proportion of C18 chains is less than 60%, preferably less than 50%, more preferably less than 40%, e.g. less than 30% by weight of the total weight of fatty acid chains in the fatty acid ester.

In the context of the present invention, "C18 chains" denotes the combined amount of C18, C18:1 and C18:2 chains.

The average proportion of C18 chains in sunflower oil, for instance, is typically above 70 wt %.

Thus, it is advantageous if at least one of the fatty acid esters is not sunflower oil so that the odour of the composition is not adversely affected.

It is preferred if the fatty acid ester is a fatty acid glyceride or mixtures of fatty acid glycerides. Especially preferred materials are triglycerides, most preferred are palm oil, palm kernel oil, and coconut oil.

Sunflower oil may also be present but preferably only in combination with one or more of the fatty acid esters defined above.

Blending different fatty triglycerides together can be advantageous since certain blends, such as coconut oil and sunflower oil, provide the composition with reduced viscosity when compared with compositions comprising only one oil. This has been found to provide the composition with better flow characteristics for the filling of capsules, which is particularly important when operating on an industrial scale.

Alkylated Sugar Esters

An alkylated sugar ester, also referred to as an oily sugar derivative, is a liquid or soft solid derivative of a cyclic polyol or of a reduced saccharide. The sugar is typically derivatised by esterifying from 10 to 100%, more preferably 20 to 100%, e.g. from 35 to 100% of the hydroxyl groups in the polyol or saccharide. The derivative usually has two or more ester groups independently attached to a $C_8$-$C_{22}$, alkyl or alkenyl chain.

Preferably alkylated sugar ester contains 35% by weight tri or higher esters, e.g. at least 40%.

Preferably 35 to 85% most preferably 40 to 80%, even more preferably 45 to 75%, such as 45 to 70% of the hydroxyl groups in the cyclic polyol or in the reduced saccharide are esterified.

For the sugar ester, the tetra, penta etc prefixes only indicate the average degrees of esterification. The compounds exist as a mixture of materials ranging from the monoester to the fully esterified ester. It is the average degree of esterification as determined by weight that is referred to herein.

The sugar ester is preferably in a liquid or soft solid state, as hereinbelow defined, at 20° C.

Typically the sugar ester has 3 or more, preferably 4 or more, for example 3 to 8, e.g. 3 to 5, ester groups or mixtures thereof. It is preferred if two or more of the ester groups of the derivative-CP and derivative-RS are independently of one another attached to a $C_8$ to $C_{22}$ alkyl or alkenyl chain. The alkyl or alkenyl groups may be branched or linear carbon chains.

Examples of preferred saccharides for the sugar ester are those derived from are monosaccharides and disaccharides.

Examples of monosaccharides include xylose, arabinose, galactose, fructose, sorbose and glucose. Glucose is especially preferred. An example of a reduced saccharide is sorbitan. Examples of disaccharides include maltose, lactose, cellobiose and sucrose. Sucrose is especially preferred.

Particularly preferred examples include sucrose tri, tetra and penta esters.

The HLB of the sugar ester is typically between 1 and 3.

The sugar ester may have branched or linear alkyl or alkenyl chains (with varying degrees of branching), mixed chain lengths and/or unsaturation. Those having unsaturated and/or mixed alkyl chain lengths are preferred.

One or more of the alkyl or alkenyl chains (independently attached to the ester groups) may contain at least one unsaturated bond.

For example, predominantly unsaturated fatty chains may be attached to the ester groups, e.g. those attached may be derived from rape oil, palm kernel oil, cotton seed oil, soybean oil, oleic, tallow, palmitoleic, linoleic, erucic or other sources of unsaturated vegetable fatty acids. Palm kernel oil is particularly preferred.

Further examples include sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of palm kernal oil, soybean oil or cotton seed oil, glucose trioleate, glucose tetraoleate, xylose trioleate, or sucrose tetra-, tri-, penta- or hexa-esters with any mixture of predominantly unsaturated fatty acid chains.

The liquid or soft solid sugar esters are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the NMR signal with a $T_2$ of less than 100 microsecond is considered to be a solid component and any component with $T_2$ greater than 100 microseconds is considered to be a liquid component.

In the premix from which the composition is prepared, it is preferred that the level of ester-containing soap precursor is from 0.5 to 60 wt %, more preferably from 2 to 30 wt %, most preferably from 5 to 20 wt %, e.g. from 8 to 15 wt %, based on the total weight of the premix.

Base Material

A base, which may be either inorganic or organic is present in the premix.

Inorganic bases are particularly preferred. Suitable examples of inorganic bases include alkali metal hydroxides or alkaline earth metal hydroxides. Potassium hydroxide and sodium hydroxide are particularly preferred.

Organic bases suitable for use in the method of the present invention include secondary, and tertiary amines, such as dimethylamine and triethanolamine.

In the premix from which the composition is prepared, it is preferred that the level of base material is from 0.5 to 20 wt %, more preferably from 2 to 15 wt %, most preferably from 4 to 10 wt %, e.g. from 5 to 8 wt %, based on the total weight of the premix.

In the reaction, it is preferred that the weight ratio of ester-containing soap precursor to base material is from 80 to 1, more preferably from 60 to 1, most preferably from 30 to 1, e.g. from 15 to 1.

Water

The reaction takes place in the presence of water.

It is preferred that the level of water in the premix is from 0.1 to 20 wt %, more preferably from 1 to 10 wt %, most preferably from 2 to 5 wt %, e.g. from 1 to 4 wt %, based on the total weight of the premix.

Solvent

Solvents can be present in the premix and/or the final composition. Preferred solvents include ethers, polyethers, alkylamines and fatty amines, (especially di- and trialkyl- and/or fatty-N-substituted amines), alkyl (or fatty) amides and mono- and di-N-alkyl substituted derivatives thereof, alkyl (or fatty) carboxylic acid lower alkyl esters, ketones, aldehydes, polyols, and glycerides.

Specific examples include respectively, di-alkyl ethers, polyethylene glycols, alkyl ketones (such as acetone) and glyceryl trialkylcarboxylates (such as glyceryl tri-acetate), glycerol, propylene glycol, dipropylene glycol and sorbitol. Dipropylene glycol is particularly preferred.

Glycerol is particularly preferred since it provides the additional benefit of plasticising the water soluble film.

Other suitable solvents are lower (C14) alcohols, such as ethanol, or higher (C5-9) alcohols, such as hexanol, as well as alkanes and olefins. It is often desirable to include them for lowering the viscosity of the product and/or assisting soil removal during cleaning.

Preferably, the solvent is present in the premix at a level of at least 0.1% by weight of the total premix. The amount of the solvent present may be as high as about 60%, but in most cases the practical amount will lie between 1 and 30% and sometimes, between 2 and 20% by weight of the premix.

It is to be understood that certain solvents which are also plasticisers, e.g. lower alcohols and polyols, can also be produced by the reaction of the soap precursor and base material. Such plasticisers are described below.

Reaction Conditions

It is desirable that the reaction takes place at elevated temperature. In particular, the reaction is preferably carried out at a temperature of from 50 to 100° C., more preferably 60 to 80° C. in order that the process is more economically viable.

In a most preferred method, the soap precursor is heated to 60 to 80° C., after which the base material is added and the mixture stirred for between 10 minutes and 4 hours. After this time, other optional ingredients are added.

Final Composition

The soap precursor and base material preferably provide from 1 to 80 wt %, more preferably from 3 to 60 wt %, most preferably from 10 to 30 wt %, e.g. from 15 to 20 wt % of soap in the final composition.

Furthermore, the reactants preferably provide from 0.1 to 15 wt %, more preferably from 0.5 to 10 wt %, most preferably from 1 to 5 wt %, e.g. from 2 to 4 wt % of plasticiser in the final composition.

Soap

A soap is present in the final composition.

Useful soap compounds include the alkali metal soaps such as the sodium, potassium, ammonium and substituted ammonium (for example monoethanolamine) salts or any combinations of this, of higher fatty acids containing from about 8 to 24 carbon atoms.

In a preferred embodiment of the invention the soap has a carbon chain length of from $C_{10}$ to $C_{22}$, more preferably $C_{12}$ to $C_{20}$.

Mixtures of coconut or palm kernel oil and for example palm oil, olive oil, sunflower oil or tallow can be used as precursors for the soap. In this case palmitate with 16 carbon atoms, stearate with 18 carbon atoms, palmitoleate with 16 carbon atoms and with one double bond, oleate with 18 carbon atoms and with one double bond and/or linoleate with 18 carbon atoms and with two double bonds are present.

The soap may be saturated or unsaturated.

Plasticiser

The reaction of the soap precursor and the base material preferably liberate a plasticiser. Typically the plasticiser is a lower alcohol.

Examples of plasticisers which can be produced by the method of the invention include lower (C1-4) alcohols, such as ethanol, or higher (C5-9) alcohols, such as hexanol, as well as polyols such as glycerol.

Preferably, the level of plasticiser is at least 0.1% by weight of the total composition. The amount of the solvent present in the composition may be as high as about 60%, but in most cases the practical amount will lie between 1 and 30% and sometimes, between 2 and 20% by weight of the composition.

Fatty Acid

A fatty acid is preferably present in the composition.

Any reference to "fatty acid" herein means "free fatty acid" unless otherwise stated and it is to be understood that any fatty acid which is reacted with another ingredient is not defined as a fatty acid in the final composition, except insofar as free fatty acid remains after the reaction.

Preferred fatty acids are those where the weighted average number of carbons in the alkyl/alkenyl chains is from 8 to 24, more preferably from 10 to 22, most preferably from 12 to 18.

The fatty acid can be saturated or unsaturated.

The fatty acid may be an alkyl or alkenyl mono- or polycarboxylic acid, though monocarboxylic acids are particularly preferred.

The fatty acid can be linear or branched. Non-limiting examples of suitable branching groups include alkyl or alkenyl groups having from 1 to 8 carbon atoms, hydroxyl groups, amines, amides, and nitrites.

Suitable fatty acids include both linear and branched stearic, oleic, lauric, linoleic, and tallow—especially hardened tallow—acids, and mixtures thereof.

The amount of fatty acid is preferably from 0.5 to 40 wt %, more preferably from 2.5 to 30 wt %, most preferably from 5 to 25 wt %, based on the total weight of the composition.

Nonionic Surfactant

Nonionic surfactants suitable for use in the compositions include any of the alkoxylated materials of the particular type described hereinafter can be used as the nonionic surfactant.

Substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is at least about 3, preferably about 5, more preferably at least about 7 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadecaethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO(18), and tallow alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$EO(14)

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

The above ethoxylated nonionic surfactants are useful in the present compositions alone or in combination, and the term "nonionic surfactant" encompasses mixed nonionic surface active agents.

The nonionic surfactant is preferably present in an amount from 1 to 30%, more preferably 2 to 12%, most preferably 3 to 9%, e.g. 4 to 8% by weight, based on the total weight of the composition.

Perfume

It is desirable that the compositions of the present invention also comprise one or more perfumes. Suitable perfume ingredients include those disclosed in "Perfume and Flavour Chemicals (Aroma Chemicals)", by Steffen Arctander, published by the author in 1969, the contents of which are incorporated herein by reference.

The perfume is preferably present in the composition at a level of from 0.5 to 15 wt %, more preferably from 1 to 10 wt %, most preferably from 2 to 5 wt %, based on the total weight of the composition.

As used herein and in the appended claims the term "perfume" is used in its ordinary sense to refer to and include any non-water soluble fragrant substance or mixture of substances including natural (i.e. obtained by extraction of flower, herb, blossom or plant), artificial (i.e. mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 1% to 70% by weight, the essential oils themselves being volatile odoriferous compounds and also serving to dissolve the other components of the perfume.

Cationic Polymer

It is desirable that the composition further comprises a cationic polymer. The cationic polymer significantly boosts softening performance on fabrics delivered by the composition.

A particularly preferred class of cationic polymer is cationic celloluse ethers. Such ethers are commercially available under the tradename Ucare LR-400 ([2-hydroxy-3(trimethylammonio)propyl]-w-hydroxypoly(oxy-1,2-ethanediyl) chloride).

The polymer is preferably present at a level of from 0.1 to 5 wt %, more preferably from 0.2 to 2 wt %, most preferably from 0.25 to 1 wt %, based on the total weight of the composition.

Water

The final composition preferably comprises a low level of water. Thus, water is preferably present at a level of from 0.1 to 10 wt %, more preferably from 2 to 10 wt %, most preferably from 3 to 7 wt %, based on the total weight of the composition.

Cationic Surfactants

The compositions of the invention are preferably substantially free, more preferably entirely free of cationic surfactants, since the compositions are primarily for use in the wash cycle of an automatic washing machine. Thus, it is preferred that the maximum amount of cationic surfactant present in the composition is 5 wt % or less, more preferably 4 wt % or less, even more preferably 3 wt % or less, most preferably 2 wt % or less, e.g. 1 wt % or less, based on the total weight of the composition.

It is well known that anionic surfactants are typically present in the wash detergent and so would complex undesirably with any cationic surfactant in the composition thereby reducing the effectiveness of the wash detergent.

Other Optional Ingredients

The compositions may also contain one or more optional ingredients conventionally included in fabric treatment compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, germicides, fungicides, anti-corrosion agents, drape imparting agents, anti-static agents, ironing aids crystal growth inhibitors, anti-oxidants, anti-reducing agents, dyes, and water activity modifiers such as sugars, salts, proteins and water soluble homo- and copolymers.

EXAMPLES

The following examples illustrate liquid laundry treatment compositions used in the invention.

Examples of the invention are denoted by a number and comparative examples are denoted by a letter.

Unless otherwise specified, the amounts and proportions in the compositions and films are by weight.

Example 1

A composition was prepared according to the method of the invention using the following ingredients:

| Ingredient | Amount (wt %) |
|---|---|
| Coconut oil (1) | 60.25 |
| Fatty acid (2) | 5.00 |
| Dipropylene glycol | 20.00 |
| Potassium hydroxide (3) | 7.00 |
| Nonionic surfactant (4) | 4.00 |
| Perfume | 3.70 |
| BHT (5) | 0.05 |

(1) ex White Sea Baltic
(2) Pristerene 4916, a hardened tallow fatty acid (ex Uniqema)
(3) Provided as a 50% solution
(4) Neodol 25-7 ex. Shell Chemicals.
(5) BHT, an antioxidant ex Aldrich The method of preparing the composition was as follows. The coconut oil, fatty acid (60% of the total amount) and dipropylene glycol were heated together to 60° C. The potassium hydroxide was added and the mixture was stirred for about 15 minutes. The remaining fatty acid (40% of total) was added and the mixture stirred until molten. The temperature was reduced to 50° C. and the nonionic surfactant added. The temperature was further reduced to 40° C. and the remaining ingredients added with stirring. The mixture was then allowed to cool under constant stirring.

The composition was analysed for soaps and glycerol using free fatty acid titration. The following ingredients were present in the final formulation.

| | |
|---|---|
| Potassium stearate/potassium palmitate | 3.42 |
| Potassium cocoate | 12.95 |
| Glycerol | 1.59 |

This demonstrates that the soap and the plasticiser for the film were produced in situ during saponification.

Softening Evaluation

The composition prepared according to the method of the invention was compared to a commercial branded unit dose fabric treatment product, Soupline Hearts (ex Colgate Palmolive purchased in France July 2004). This is referred to as example A.

A mixed ballast load comprising 25% Terry towel, 25% jersey, 25% poly-cotton, and 25% cotton sheeting together with eight 20 cm×20 cm Terry Towel monitors was added to a Miele 820 front loading automatic machine. The machine was set to a 40° C. cotton cycle. Example A (1 Soupline Heart) was added to the drum in a net bag provided with the product and used with 110 g of Persil non-biological powder, which was un-perfumed. Example 1 (25 ml) was encapsulated in M8630 poly(vinylalcohol) film of 76 micron thickness via a simple heat sealing process was added to the drum and placed at the back on top of the ballast. After the wash, rinse and spin cycles were complete the monitors were extracted, and left to dry on a line for 24 hours prior to softness and perfume assessment.

Softening assessment was conducted by a trained panel of at least six panellists who were asked to rank the monitors on a scale 0-100, by placing a mark along a line which had ends marked 0 and 100 respectively. 0 denotes not at all soft and 100 denotes extremely soft.

The results were statistically analysed again using the Tukey-Hamer HSD package.

| Sample | Softening |
|---|---|
| Example A | 43 |
| Example 1 | 53 |

Examples 2 to 5

The following compositions were prepared according to the method of the invention.

| Material | Example 2 | Example 3 | Example 4 | Example 5 |
|---|---|---|---|---|
| Coconut Oil | 54.93 | 49.93 | 39.93 | 19.93 |
| Sucrose Polyester-Palm Kernal (SPE-PK) | 5 | 10 | 20 | 40 |
| KOH (50%) (a) | 6.5 | 6.5 | 6.5 | 6.5 |
| Pristerene 4916 | 6.5 | 6.5 | 6.5 | 6.5 |
| Priolene 6907 (b) | 16 | 16 | 16 | 16 |
| Neodol 25-7 (c) | 6.5 | 6.5 | 6.5 | 6.5 |
| Baypure (50%) (d) | 0.6 | 0.6 | 0.6 | 0.6 |
| BHT (e) | 0.05 | 0.05 | 0.05 | 0.05 |
| Perfume | 3.5 | 3.5 | 3.5 | 3.5 |
| Dye (1%) | 0.4 | 0.4 | 0.4 | 0.4 |

(a) KOH employed to form the soap from the Priolene 6907;
(b) Oleic acid fatty acid ex. Uniqema
(c) Ethoxylated non-ionic with an average of 7EO ex. Shell
(d) Sequestrant sodium iminosuccinate ex. Bayer
(d) 2,6-dibutyl-4-methyl phenol; Anti-foam ex. Dow Corning Preparation To a 500 ml beaker fitted with a Heidolph overhead stirrer a twin bladed mixer, a thermocouple, a water bath was charged coconut oil, and Priolene 6907. The mixture was warmed to 65° C. and agitation started at 260 to 300 r.p.m. The KOH was then added slowly over 10 minutes keeping the temperature below 70° C. After the KOH was added the solution was left to stir for a further 10 minutes, after which the stearic acid (Pristerene 4916) was added and allowed to dissolve. When the product was clear the beaker was removed from the water bath and allowed to cool under agitation. At 50° C. the Neodol 25-7E and the SPE-PR were added as a melt over 2 minutes. At 45° C. the perfume, Baypure (50% aqueous solution), dye and BHT were added. The product was then left to cool to below 30° C. before the agitation was stopped. The final product was an opaque fatty acid structured oil.

Encapsulation

The compositions (25 ml) were encapsulated in M8630 poly(vinylalcohol) film of 76 micron thickness via a simple heat sealing process.

Softening Performance:

A mixed ballast load comprising 25% Terry towel, 25% jersey, 25% poly-cotton, and 25% cotton sheeting together with eight 20 cm×20 cm Terry towel monitors was added to a Miel 820 front loading automatic machine. The machine was set to a 40° C. cotton cycle and used with 110 g of Persil non-biological. The encapsulated composition (25 ml) was added to the drum and placed at the back on top of the ballast.

After the wash, rinse and spin cycles were complete the monitors were extracted, and left to dry on a line for 24 hours prior to softness assessment.

Softening assessment was also conducted by a trained panel of at least six panellists who were asked to rank the monitors on a scale 0 to 100, when 0 denotes 0 not at all soft and 100 denotes extremely soft. Each panellist placed a mark along a line which had each end marked 0 and 100.

The results were statistically analysed again using the Tukey-hamer HSD package.

| Example | Softening |
|---|---|
| 2 | 45 |
| 3 | 52 |
| 4 | 59 |
| 5 | 60 |

As can be seen from the results the increase in sucrose polyester shows an improvement in softening performance.

The invention claimed is:

1. A method of preparing a unit dose fabric treatment product comprising:

preparing a liquid fabric treatment composition comprising one or more soaps and a plasticizer from a premix composition comprising (a) an ester-containing soap precursor, (b) a base material, (c) optionally a solvent, and (d) water, wherein the amount of water in the premix composition is from 0.1 to 20 wt % of the premix composition, wherein components (a), (b) and (c) are reacted together, in the presence of the water, at a reaction temperature of from 50 to 100° C. to produce the one or more soaps and the plasticizer; and placing the liquid fabric treatment composition in a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxyl alkyl, carboxy methyl cellulose sodium, dextrin, maltodextrin, water soluble poly-acrylates, water soluble polyacrylamides and acrylic acid/maleic anhydride copolymers.

2. A method according to claim 1, wherein the liquid fabric treatment composition is a fabric softening composition, and wherein the ester-containing soap precursor includes an alkylated sugar ester.

3. A method according to claim 2 wherein the alkylated sugar ester is a sucrose polyester.

4. A method according to claim 1 wherein the ester-containing soap precursor includes a fatty acid ester.

5. A method according to claim 4 wherein the fatty acid ester is a fatty acid triglyceride.

6. A method according to claim 1 wherein the base material is an inorganic base.

7. A method according to claim 6 wherein the inorganic base is an alkali metal hydroxide.

8. A method according to claim 1 wherein the base material is an organic base.

9. A method according to claim 1 in which the liquid fabric treatment composition further comprises from 0.1 to 10% by weight of water.

10. A method according to claim 1 wherein the reaction is carried out at a temperature of from 60 to 80° C.

11. A method according to claim 1 wherein the reactants provide from 0.1 to 15 wt % of plasticizer in the final composition.

12. A method according to claim 1 wherein the reactants provide from 0.5 to 10 wt % of plasticizer in the final composition.

13. A method according to claim 1 wherein the reactants provide from 1 to 5 wt % of plasticizer in the final composition.

14. A method according to claim 1, wherein the ester-containing soap precursor includes a fatty acid ester and an alkylated sugar ester, wherein the fatty acid ester is about 50 wt % of the premix composition and wherein the alkylated sugar ester is about 10 wt% of the premix composition.

15. A method according to claim 1, wherein the ester-containing soap precursor includes a fatty acid ester and an alkylated sugar ester, wherein the fatty acid ester is about 40 wt % of the premix composition and wherein the alkylated sugar ester is about 20 wt % of the premix composition.

16. A method according to claim 1, wherein the ester-containing soap precursor includes a fatty acid ester and an alkylated sugar ester, wherein the fatty acid ester is about 20 wt % of the premix composition and wherein the alkylated sugar ester is about 40 wt % of the premix composition.

17. A method of preparing a unit dose fabric treatment product comprising, in no particular order:

(i) providing a fabric treatment composition prepared from a premix composition comprising (a) an ester-containing soap precursor, (b) a base material, (c) optionally a solvent, and (d) water, wherein the amount of water in the premix composition is from 0.1 to 20 wt % of the premix composition, wherein components (a), (b) and (c) were reacted together, in the presence of the water, at a reaction temperature of from 50 to 100° C.;

(ii) providing a unit dose water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxyl alkyl, carboxy methyl cellulose sodium, dextrin, maltodextrin, water soluble poly-acrylates, water soluble polyacrylamides and acrylic acid/maleic anhydride copolymers;

(iii) introducing the composition into the water soluble container; and (iv) closing the container.

18. A method according to claim 17 wherein a plasticizer is produced by the reaction of the soap precursor and the base material.

19. A method according to claim 18 wherein the reactants provide from 0.1 to 15 wt % of plasticizer in the final composition.

20. A method according to claim 18 wherein the reactants provide from 0.5 to 10 wt % of plasticizer in the final composition.

21. A method according to claim 18 wherein the reactants provide from 1 to 5 wt % of plasticizer in the final composition.

22. A method according to claim 17, wherein the fabric treatment composition is a fabric softening composition, and wherein the ester-containing soap precursor includes an alkylated sugar ester.

* * * * *